United States Patent [19]

Thompson

[11] 4,226,051

[45] Oct. 7, 1980

[54] LOUVRE WINDOWS

[75] Inventor: Norman Thompson, Bridgnorth, England

[73] Assignee: Beta Aluminium Products Limited, Bridgnorth, England

[21] Appl. No.: 941,805

[22] Filed: Sep. 12, 1978

[30] Foreign Application Priority Data

Sep. 15, 1977 [GB] United Kingdom ..... 38486/77

[51] Int. Cl.[2] ..... E06B 7/08

[52] U.S. Cl. ..... 49/403

[58] Field of Search ..... 49/403

[56] References Cited

U.S. PATENT DOCUMENTS

| | | | |
|---|---|---|---|
| 2,708,295 | 5/1955 | Johnson | 49/403 |
| 2,952,885 | 9/1960 | Richardson | 49/403 |

*Primary Examiner*—Kenneth Downey

*Attorney, Agent, or Firm*—Young & Thompson

[57] ABSTRACT

A blade holder for a louvre window comprises an elongated member having a first longitudinally extending groove with an inwardly facing opening for receiving an end edge of a louvre blade, means intermediate the ends of the member for pivotally mounting the member on a window frame element, a second longitudinally extending groove in the elongated member, parallel to the first groove, and a metal elongated reinforcement element for mounting in said second groove. The reinforcement element preferably extends across the common wall between the two grooves to engage the louvre blade, and may also be adhesively bonded to the louvre blade.

5 Claims, 4 Drawing Figures

LOUVRE WINDOWS

BACKGROUND OF THE INVENTION

This invention relates to louvre windows, and in particular to blade holders for louvre windows of the kind comprising a rectangular window frame structure on opposite side elements of which are pivotally mounted a plurality of blade holders, there being provided a plurality of elongated louvre blades extending across the frame structure and having their opposite end edges held in opposing blade holders so that the blades may be pivoted about their longitudinal axes.

In this specification the term "inwardly", when used in relation to a blade holder, will mean the direction towards the corresponding and opposing blade holder.

One weakness of known designs of louvre window is that it is possible to remove an individual louvre blade due to the fact that the blades are supported only at their two ends. Depending on the strength of the materials used and the design of the blade holders, it is usually possible to remove those parts of the blade holders which retain the blades, by sawing or otherwise rupturing the blade holder so that the blade, which is usually of glass, may be slid out of the holders to give unauthorised access through the window. The object of the invention is to provide blade holders where, even if the holders are damaged, the blade held by them will remain in position, thus preventing access through the window unless the blade itself is broken.

SUMMARY OF THE INVENTION

According to the invention a blade holder for a louvre window comprises an elongated member having a first longitudinally extending groove with an inwardly facing opening for receiving an end edge of a louvre blade, means intermediate the ends of the member for pivotally mounting the member on a window frame element, a second longitudinally extending groove in the elongated member, and an elongated reinforcement element for mounting in said second groove.

The reinforcement element serves to strengthen the blade holder, making it more difficult to remove the blade by damaging the holder. The first and second longitudinally extending grooves may be separated by a common wall of smaller depth than the reinforcement element, the element, which is preferably formed from metal, being shaped to project across the common wall to engage the louvre blade. Preferably an adhesive bond is effected between adjacent surfaces of the louvre blade and the reinforcement element to prevent separation thereof. The reinforcement element thus serves to retain the blade in position even though other parts of the blade holder may be damaged.

Preferably the reinforcement element is disposed on that side of the louvre blade which is intended to be on the interior side of the window when the window is fitted in a building.

In the case where the means for pivotally mounting the elongated member on a window frame element has a portion thereof facing inwardly of the blade holder, said reinforcement element, when received in said second longitudinally extending groove, preferably covers said inwardly facing portion to prevent access thereto.

DESCRIPTION OF THE PREFERRED EMBODIMENT

Figure 1:
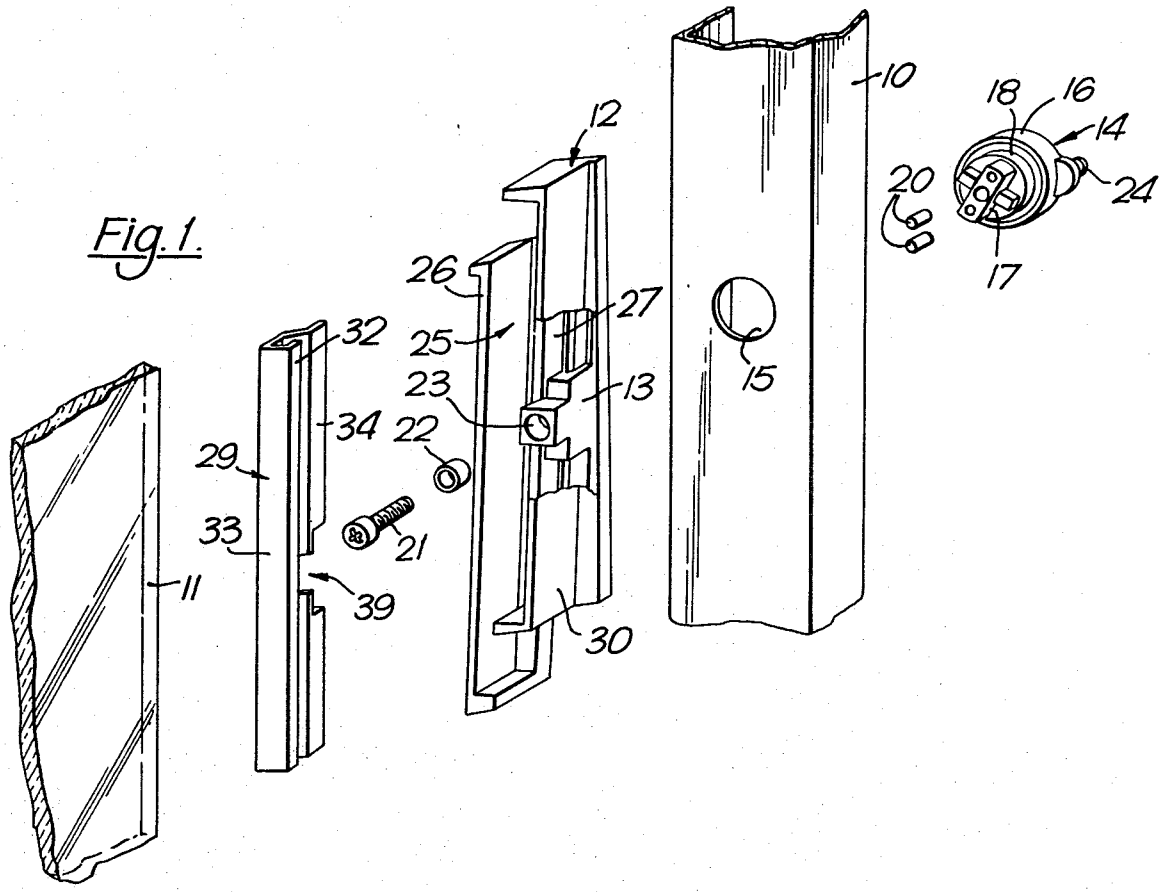
FIG. 1 is an exploded perspective view of some of the components of a louvre window, including a blade holder according to the invention.
Figure 4:
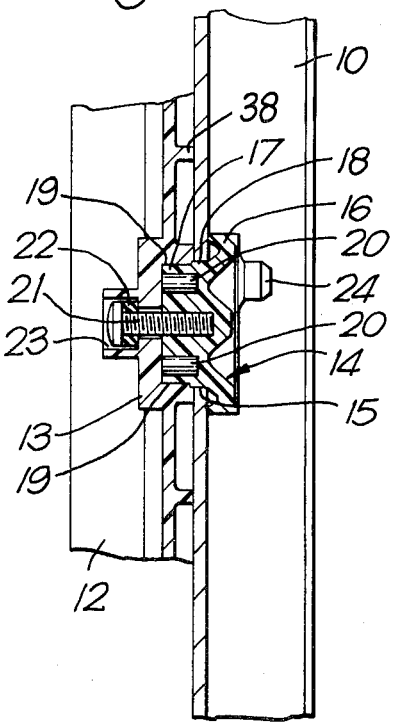
FIG. 4 is a vertical section through a part of the blade holder showing the means for pivotally mounting it on a window frame element.
Figure 2:
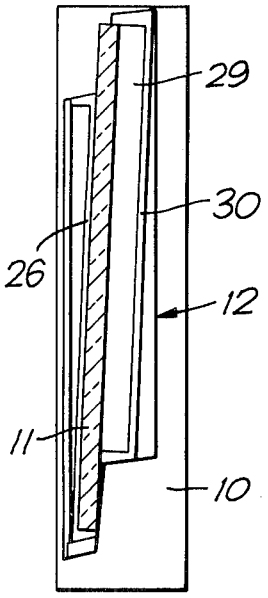
FIG. 2 is a section, through the louvre blade, showing the components assembled together.
Figure 3:
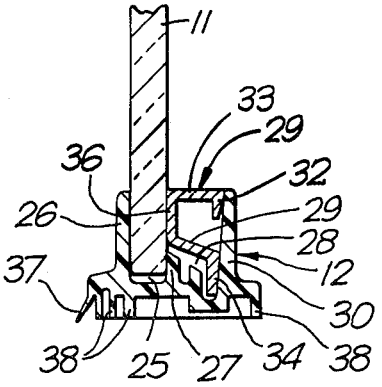
FIG. 3 is a sectional view of the blade holder.

The louvre window comprises a surrounding frame structure the jambs of which are formed from aluminium extrusions of channel section. Part of one vertical jamb 10 is shown in FIGS. 1, 3 and 4. Each louvre consists of a glass blade 11 opposite ends of which are each received in a blade holder. Each blade holder comprises an elongated member 12 having a central hollow boss 13 which is engaged by a drive plate 14 which projects through a circular aperture 15 in the jamb.

The drive plate 14 is formed as a moulding from an acetal resin and consists of a main body 16 and a boss 17 formed integrally therewith, the body and boss being separated by a bearing portion 18 of such dimension that, when the boss is passed through the aperture 15 formed in the jamb of the window frame, the body 16 bears against the surround of the aperture.

The bearing portion 18 of the drive plate is a close fit in the aperture 15 in the jamb and the boss 17 is of cruciform cross-section for making engagement with a rebate 19 of corresponding configuration formed in the boss 13 of the blade holder. Two opposing arms of the boss 17 are each formed with holes to receive hardened steel pins 20 which, as shown in FIG. 4, extend across the junction between the blade holder and the jamb 10 to prevent the drive plate being sawn through by a saw blade inserted between the blade holder and the jamb.

The blade holder is connected to the drive plate by means of a screw 21 which passes through the boss 13 and into the drive plate, a rubber washer 22 being disposed between the head of the screw and the base of a socket 23 in the boss which receives the head of the screw.

The part of the drive plate body remote from the jamb 10 includes two projecting pegs 24 to which a louvre operating linkage mechanism (not shown) is attached so that a drive can be transmitted from an operating mechanism to the louvre blade held by the blade holder.

The elongated member 12 of the blade holder is formed as a one-piece moulding from a synthetic plastics material such as polypropylene and has a first longitudinally extending groove 25 to receive one end edge of the glass louvre blade 11. The side wall 26 of the groove 25 which is on the exterior of the window is of substantially uniform thickness and provides for substantially face-to-face engagement with the blade 11 so that effective sealing is obtained. The other side wall 27 of the groove 25 is of lower depth than the outer side wall and forms a common wall between the first groove and a second groove 28 which is designed to receive a metal reinforcement element 29, the metal reinforcement element being on the interior side of the louvre blade 11 so that when the louvre blade is in position access to the metal reinforcement element cannot be obtained from the exterior of the building in which the louvre window is fitted. The interior side wall 30 of the second groove is inclined (as best seen in FIG. 3) so that a tapering engagement of the metal reinforcement element 29 in the groove is obtained.

As also best seen in FIG. 3, the metal reinforcement element 29 is generally channel-shaped in cross section with an inwardly projecting lip 32 at the extremity of one side wall 33, and an outwardly projecting flange 34 at the extremity of the other side wall 35 of the channel section. The side wall 33 having the inwardly projecting lip 32 has a surface which is substantially flush with the inwardly facing surface of the elongated member 12, and the web 36 of the channel section projects across the common wall 27 between the two grooves in the blade holder and engages the surface of the blade 11.

The side wall 35 and flange 34 of the reinforcement element 29 are notched, as indicated at 39 in FIG. 1, so as to fit closely over the central boss 13 in the blade holder, so that when the reinforcement element is pressed into position in the groove 28 it cannot slide along the groove. In addition the side wall 33 of the metal reinforcement element 29 completely covers the fixing screw 21, so that access to the fixing screw cannot be obtained from the exterior of the window. Before insertion of the reinforcement element 29 the end edge of the louvre blade 11 is first inserted in the groove 25 and then a layer of adhesive, such as an anaerobic adhesive, specially formulated to give a bond between the metal and glass which is as strong as the glass itself, is applied to the surface of the web 36 of the reinforcement element which bears against the blade so that the element is positively bonded to the blade.

The surface of the blade holder adjacent the jamb is provided with a wiper blade 37 which has a narrow profile and terminates in a lip which forms a seal with the surface of the jamb. The blade holder is also formed with strengthening ribs 38 which bear against the jamb surface so that a weather-proof seal is obtained.

The important advantage of the particular construction described above is that even though the blade holder may be substantially damaged from the exterior of the window by cutting, sawing or otherwise rupturing, the glass blade will still be held in position by virtue of adhering strongly to the metal reinforcement element which itself cannot be attacked from the exterior of the window.

I claim:

1. A blade holder for a louvre window comprising an elongated member, a first longitudinally extending groove in the elongated member with an inwardly facing opening for receiving an end edge of a louvre blade, means intermediate the ends of the member for pivotally mounting the member on a window frame element, a second longitudinally extending groove in the elongated member, and an elongated reinforcement element for mounting in said second groove, said first and second longitudinally extending grooves being separated by a common wall of smaller depth than the reinforcement element, and said element being shaped to project across the common wall to engage the louvre blade when the reinforcement element and the louvre blade are received in their respective grooves.

2. A blade holder according to claim 1, wherein an end edge of a louvre blade is received in said first longitudinally extending groove, and said reinforcement element is received in said second longitudinally extending groove, and an adhesive bond is effected between adjacent surfaces of the louvre blade and the reinforcement element to prevent separation thereof.

3. A blade holder for a louvre window comprising an elongated member, a first longitudinally extending groove in the elongated member with an inwardly facing opening for receiving an end edge of a louvre blade, means intermediate the ends of the member for pivotally mounting the member on a window frame element, a second longitudinally extending groove in the elongated member, and an elongated reinforcement element for mounting in said second groove, said elongated member having an inwardly facing surface and the reinforcement element having a first surface which is substantially flush with the inwardly facing surface of the elongated member when the reinforcement element is received in said second longitudinally extending groove, and wherein said reinforcement element is generally channel-shaped in cross-section and has an inwardly projecting lip on the extremity of one side wall thereof, and an outwardly projecting flange on the extremity of the other side wall thereof, the side wall which has the inwardly projecting lip providing said surface which is substantially flush with the inwardly facing surface of the elongated member when the reinforcing element is received in its groove, the web of the channel section being engageable with the surface of the louvre blade when said louvre blade is received in said first longitudinally extending groove, and the outwardly projecting flange extending towards the bottom of said second longitudinally extending groove.

4. A blade holder according to claim 3, wherein the side wall of the channel section which has said inwardly projecting lip extends substantially at right angles to the web of the channel section, the other side wall being inclined away from the first said side wall.

5. A blade holder for a louvre window comprising an elongated member, a first longitudinally extending groove in the elongated member with an inwardly facing opening for receiving an end edge of a louvre blade, means intermediate the ends of the member for pivotally mounting the member on a window frame element, a second longitudinally extending groove in the elongated member, and an elongated reinforcement element for mounting in said second groove, and wherein said means for pivotally mounting the elongated member on a window frame element includes an inwardly facing boss formed on the elongated member intermediate the ends thereof, and the reinforcement element is formed, intermediate its ends, with a notch which engages over the boss on the elongated member to prevent movement of the reinforcement element along the elongated member.

* * * * *